US009083103B2

(12) United States Patent
Bandis et al.

(10) Patent No.: US 9,083,103 B2
(45) Date of Patent: Jul. 14, 2015

(54) METHOD AND APPARATUS FOR PREVENTING ACCESS TO ELECTRICAL CONTACTS

(71) Applicant: Varian Medical Systems, Inc., Palo Alto, CA (US)

(72) Inventors: Steven Douglas Bandis, West Jordan, UT (US); Marcelo C. Costa, Draper, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 217 days.

(21) Appl. No.: 13/753,506

(22) Filed: Jan. 29, 2013

(65) Prior Publication Data

US 2014/0213112 A1 Jul. 31, 2014

(51) Int. Cl.

| | |
|---|---|
| ***H01R 13/50*** | (2006.01) |
| ***H01R 13/447*** | (2006.01) |
| *H01R 24/28* | (2011.01) |
| *H01R 107/00* | (2006.01) |

(52) U.S. Cl.

CPC ..... *H01R 13/447* (2013.01); *H01R 24/28* (2013.01); *H01R 2107/00* (2013.01); *H01R 2201/12* (2013.01)

(58) Field of Classification Search

CPC ..... H01R 13/50
USPC ..... 439/626, 133–135, 752, 843, 911, 851, 439/680

See application file for complete search history.

(56) References Cited

U.S. PATENT DOCUMENTS

| | | | | |
|---|---|---|---|---|
| 4,818,237 | A * | 4/1989 | Weber | 439/693 |
| 4,900,261 | A | 2/1990 | Gentry et al. | |
| 5,281,168 | A * | 1/1994 | Krehbiel et al. | 439/595 |
| 5,588,852 | A | 12/1996 | Puerner | |
| 6,203,353 | B1 | 3/2001 | Huang et al. | |
| 6,334,794 | B1 | 1/2002 | Crane, Jr. et al. | |
| 7,497,731 | B2 | 3/2009 | Rosenfeldt et al. | |
| RE41,283 | E * | 4/2010 | Evans et al. | 439/680 |

OTHER PUBLICATIONS

PCT, International Search Report and Written Opinion in PCT/US2014/013464, May 20, 2014, 11 pages.

* cited by examiner

*Primary Examiner* — Edwin A. Leon
(74) *Attorney, Agent, or Firm* — Houst Consulting

(57) ABSTRACT

An electrical contact device may include an insulating first body having a first surface, one or more electrical contacts received in the first body and protruding a distance from the first surface, and an insulating second body configured to prevent access by an object such as a human body portion to the protruding electrical contacts. The second body may include a first side wall and a second side wall which are configured to allow the one or more electrical contacts protruding from the first surface to be interposed between the first and second side walls. The first and second side walls may define a width smaller than a dimension of an object such as a body portion so that access by the object to the one or more electrical contacts protruding from the first surface can be prevented.

21 Claims, 8 Drawing Sheets

METHOD AND APPARATUS FOR PREVENTING ACCESS TO ELECTRICAL CONTACTS

TECHNICAL FIELD

This disclosure relates generally to medical electrical equipment and in particular to methods and apparatuses for preventing access to electrical contacts, which can be used to improve safety for medical electrical equipment and used in other applications.

BACKGROUND

Medical electrical equipment plays an important role in healthcare and is used in a wide range of applications including diagnosis, treatment, and monitoring of patients. For example, x-ray machines are widely used in diagnostic imaging, radiotherapy of tumors, and monitoring patients in pre- and post treatment. However, medical electrical equipment may also present a range of risks or hazards to patients, users, or other personnel. One of the risks is the potential to expose people to electrical shock.

In efforts to ensure safety for medical electrical equipment, various standards, codes, and tests have been implemented by various organizations and governments. For example, International Electrotechnical Commission (IEC) has published international standards for electrical, electronic, and related technologies. IEC 60601-1 published in 2005 provides the general requirements for safety for medical electrical equipment. Compliance with IEC 60601-1 has been becoming increasingly important in assessing the safety or risks associated with medical electrical equipment manufactured.

SUMMARY

Methods and apparatuses for separating electrically active contacts or preventing access to electrical contacts to improve safety are described herein. In some embodiments, a separating wall may be used such that electrical contacts in close proximity cannot be accessed or shorted together. In some embodiments, electrical contacts may be placed in recesses in an insulating body member such that access to the recessed contacts by a human body portion such as a human finger is prevented. The methods and apparatuses described herein can be implemented with respect to either single electrical contact or multiple contacts in a single row, multiple rows, or other array configurations. The electrical contacts can be either male or female contacts, either flat face contacts or spring-loaded contacts etc. The methods and apparatuses described herein allows for first contact last disconnect for hot-swappable situations through the use of raised contacts and through recessed contacts of differing contact heights.

Other embodiments are further described herein.

BRIEF DESCRIPTION OF THE DRAWINGS

These and other features and advantages of the disclosed methods and apparatuses will become better understood upon reading of the following detailed description in conjunction with the accompanying drawings and the appended claims provided below, where:

DETAILED DESCRIPTION

Figure 1:
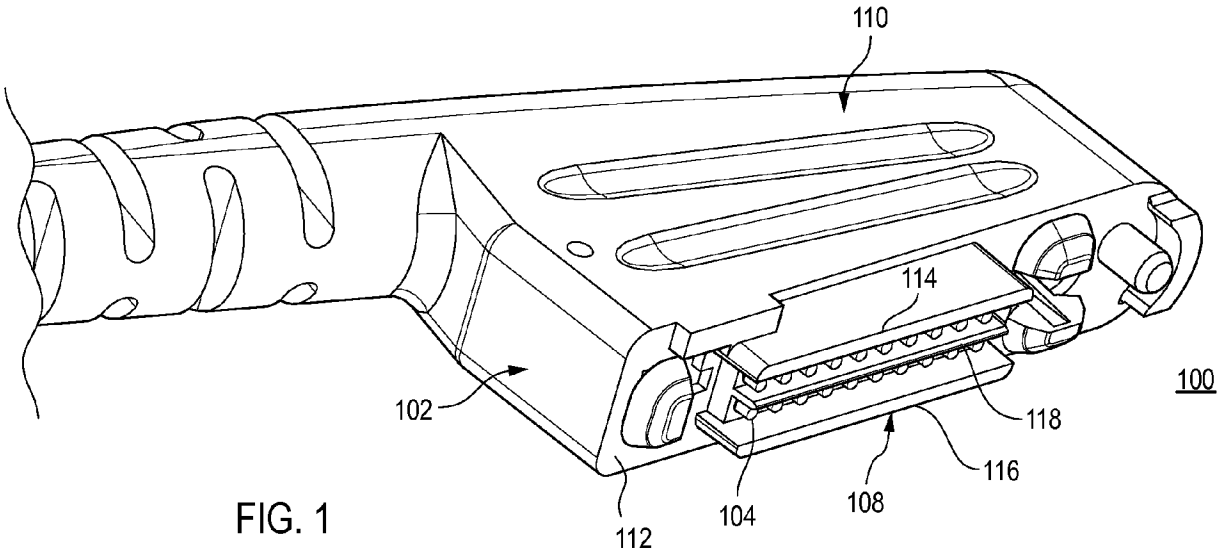
FIG. 1 is a perspective view of an exemplary electrical cable assembly according to some embodiments of this disclosure.

Various methods and devices for preventing access to electrically active contacts are described. It is to be understood that the disclosure is not limited to the particular embodiments described as such which may, of course, vary. An aspect described in conjunction with a particular embodiment is not necessarily limited to that embodiment and can be practiced in any other embodiments. For instance, while various embodiments are shown and described in conjunction with an electrical cable assembly, it will be appreciated that the devices and methods described herein can also be used in other applications.

Various relative terms such as "above," "below," "top," "bottom," "height," "depth," "width," and "length," etc. may be used to facilitate description of various embodiments. The relative terms are defined with respect to a conventional orientation of a structure and do not necessarily represent an actual orientation of the structure in manufacture or use. The following detailed description is, therefore, not to be taken in a limiting sense.

As used in the description and appended claims, the singular forms of "a," "an," and "the" may include plural references unless the context clearly dictates otherwise. For example, reference to "an electrical contact" may include one or more electrical contacts.

In some embodiments of this disclosure, an electrical contact device may include an insulating first body having a first surface, one or more electrical contacts received in the first body and protruding a distance from the first surface, and an insulating second body configured to prevent an object such as a human body portion from touching the electrical contacts protruding from the first surface of the first body. The second body may include a first side wall and a second side wall which are configured to allow the one or more electrical contacts protruding from the first surface to be interposed between the first and second side walls. The first and second side walls may each define a height from the first surface that is greater than the distance of the electrical contacts protruding from the first surface. The first and second side walls may define a width that is smaller than a dimension of an object such as a human body portion so that access by the object to the one or more electrical contacts protruding from the first surface can be prevented.

The electrical contacts interposed between the first and second side walls can be either a single electrical contact or multiple electrical contacts in a single row, multiple rows, or other array configurations. In case of multiple electrical contacts in multiple-row configurations, the second body may include one or more dividing walls or dividers between the first and second side walls. By way of example, a plurality of electrical contacts may be received in the first body and protrude from the first surface in two rows. The second body may include a first side wall, a second side wall, and a divider between the first and second side walls. The first, second side walls and the divider may be configured such that the two rows of electrical contacts protruding from the first surface are sandwiched between the first and second side walls, and the divider separates, or is interposed between, the two rows of the protruding contacts. The divider and the first side wall, and/or, the divider and the second side wall, may define a width that is smaller than a dimension of an object e.g. a human body portion such that the object is not capable of touching adjacent electrical contacts in a same row or in neighboring rows. The multiple electrical contacts may also be arranged in more than two rows protruding from the first surface and the second body may correspondingly include two or more dividers each being interposed between, or separating, two adjacent rows of contacts. The multiple electrical contacts protruding from the first surface may also be arranged in other array configurations, and the number and orientation of the dividers may be selected based on the array configurations of the electrical contacts.

In some embodiments, an electrical contact device may include an insulating first body having a first surface and one or more recesses through the first surface. One or more electrical contacts may be received in the one or more recesses and below the first surface of the first body. The one or more recesses may define an opening dimension in the first surface that is smaller than a dimension of an object such as a human body portion so that access to the electrical contacts in the recesses by the object can be prevented. The depth from the first surface of the first body to the electrical contacts in the recesses may also be selected to prevent the body portion from touching the electrical contacts.

The first body may have a plurality of recesses in a single row, multiple rows, or other array configurations. A plurality of electrical contacts may be received in the plurality of recesses arranged in a single row, multiple rows, or other array configurations. In cases of multiple recesses/contacts in multiple-row configurations, the first body may also include one or more slots between two adjacent rows of the recesses/contacts. By way of example, the first body may have a plurality of recesses arranged in two rows. A slot may be provided in the first body between and extending along the two rows of recesses. The slot may be configured to receive a divider in the electrical contact device described above. It will be appreciated that the multiple recesses/contacts may also be arranged in more than two rows and the first body may correspondingly include two or more slots each between two adjacent rows of recesses/contacts. The multiple recesses/contacts may also be arranged in other configurations, and the number and orientation of the slots may be selected based on the configurations of the recesses/electrical contacts.

In some embodiments, an electrical connector assembly may include a male first component, a female second component, and a third component configured to prevent an object such as a human body portion from accessing the electrical contacts in the first component. The male first component may include a first body and one or more first electrical contacts received in and protruding from the first body. The female second component may include a second body and one or more second electrical contacts received in the second body configured to mate with the one or more first electrical contacts protruding from the first body. The third component may include a third body having a first side wall and a second side wall. The first and second side walls of the third body may each define a height greater than the distance of the one or more electrical contacts protruding from the first body. The first and second side walls of the third body may define a width smaller than a dimension of an object such as a human body portion so that the object is not capable of touching the one or more electrical contacts protruding from the first body.

The female second component may also be configured to prevent an object such as a human body portion from touching the electrical contacts in the second body. The second body of the female second component may include a surface and one or more recesses through the surface. The one or more second electrical contacts may be received in the one or more recesses and below the surface of the second body. The one or more recesses in the second body may define an opening dimension that is smaller than an object such as a body portion so that access to the recessed electrical contacts by the body portion can be prevented.

The male first component may include a plurality of first electrical contacts protruding from the first body in a single row, multiple rows, or other array configurations. The female second component may include a plurality of second electrical contacts in a plurality of recesses in a single row, multiple rows, or other array configurations configured to mate with the plurality of first electrical contacts. By way of example, each of the male and female components may include a plurality of contacts in two rows configured to mate each other. The third component may include a dividing wall or a divider between the first and second side walls. The first, second side walls and the divider may be configured such that the two rows of electrical contacts protruding from the first body are sandwiched between the first and second side walls, and the divider separates, or is interposed between, the two rows of the protruding contacts. The female second component may include a slot configured to receive the divider when the male first component engages the female second component. It will be appreciated that a plurality of first electrical contacts may be arranged in more than two rows and a plurality of second electrical contacts may be arranged in more than two rows. As such, two or more dividers may be provided in the third component and two or more slots may be provided in the second components. The plurality of electrical contacts may also be arranged in other array configurations, and the number and orientation of the dividers and slots may be selected based on the configurations of the electrical contacts.

In some embodiments, an electrical cable assembly includes a first body having a first surface, one or more electrical contacts received in the first body and protruding a distance from the first surface, and one or more wires or cables electrically coupled to the one or more electrical contacts. The cable assembly also includes a second body having a first side wall and a second side wall. The first and second side walls are configured such that the one or more electrical contacts protruding from the first surface are interposed between the first and second walls. The first and second side walls may each define a height greater than the distance protruding from the first surface. The first and second side walls may define a width smaller than a dimension of an object such as human body portion so that the object is not capable of touching the one or more electrical contacts protruding from the first surface.

The cable assembly may include a plurality of electrical contacts protruding from the first body in a single row, multiple rows, or other array configurations and a plurality of wires or cables electrically coupled to the plurality of contacts. By way of example, the cable assembly may include a plurality of contacts protruding from the first body in two rows and a plurality of cables coupled to the plurality of contacts. The second body may include a dividing wall or a divider between the first and second side walls. The first, second side walls and the divider may be configured such that the two rows of electrical contacts protruding from the first surface are sandwiched between the first and second side walls, and the divider separates, or is interposed between, the two rows of the protruding contacts. The divider and one of the first and second side walls may define a width smaller than a dimension of an object such as a human body portion to prevent the object from touching the plurality of electrical contacts protruding from the first body.

Exemplary embodiments are now described with reference to the figures. It should be noted that some figures are not drawn to scale. The figures are only intended to facilitate the description of specific embodiments and are not intended as an exhaustive description or as a limitation on the scope of the invention.

Figure 2:
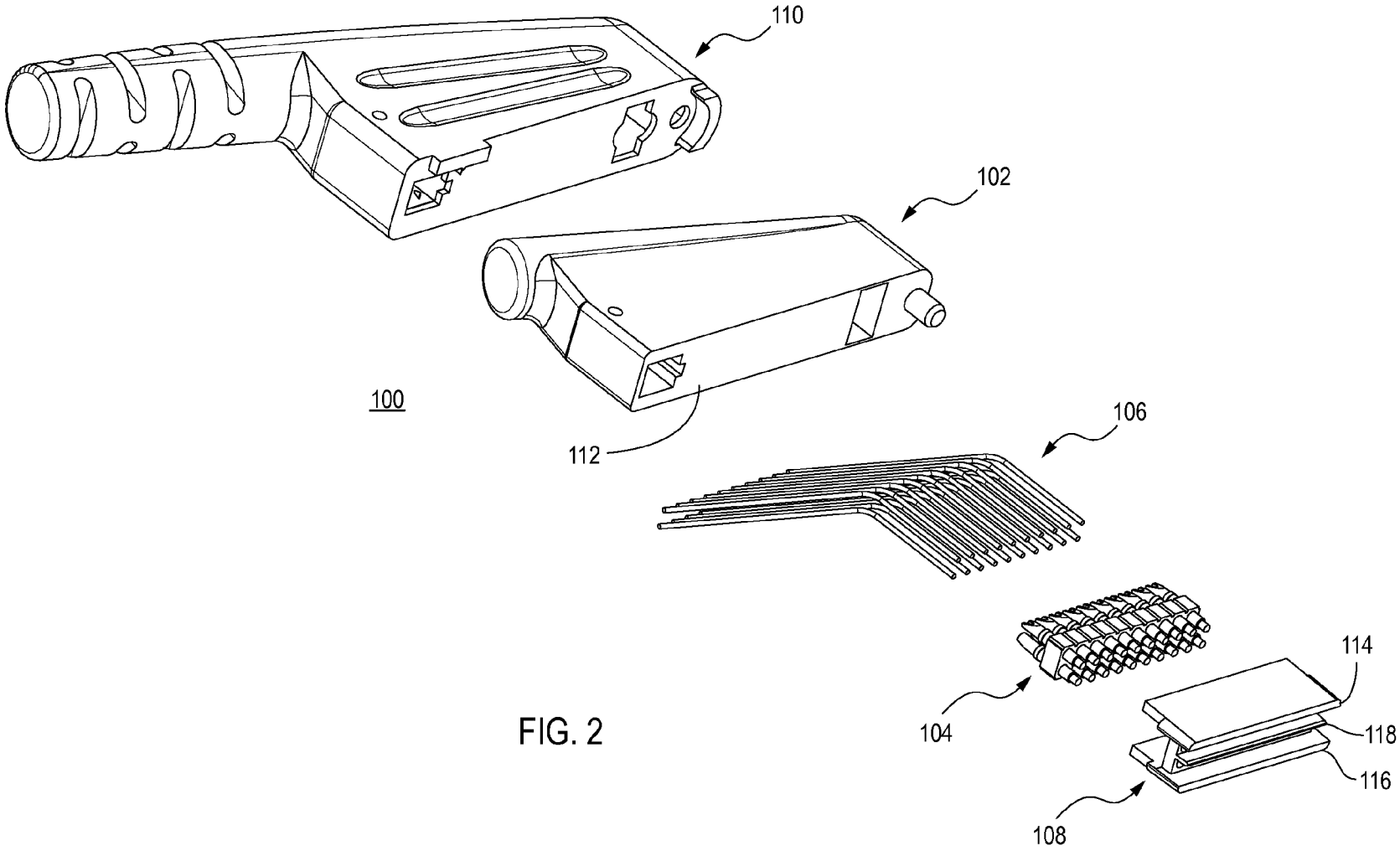
FIG. 2 is a simplified exploded view of the electrical cable assembly illustrated in FIG. 1.

FIG. 1 illustrates an exemplary electrical cable assembly 100 that can implement the principles of this disclosure. FIG. 2 is a simplified exploded view of the cable assembly 100 illustrated in FIG. 1. As shown, the cable assembly 100 may include an insulating body or a first body 102, a plurality of electrical contacts 104 received in or supported by the first body 102, and a plurality of wires or cables 106 (FIG. 2) electrically coupled to the plurality of contacts 104. The cable assembly 100 may include an access limiting body or a second body 108 configured to prevent an object such as a human body portion from accessing or touching the electrical contacts 104 protruding from the first body 102. Suitable overmold or molded body 110 may be included to encapsulate the first body 102, the electrical contacts 104, the cables 106, and other elements.

Figure 1A:
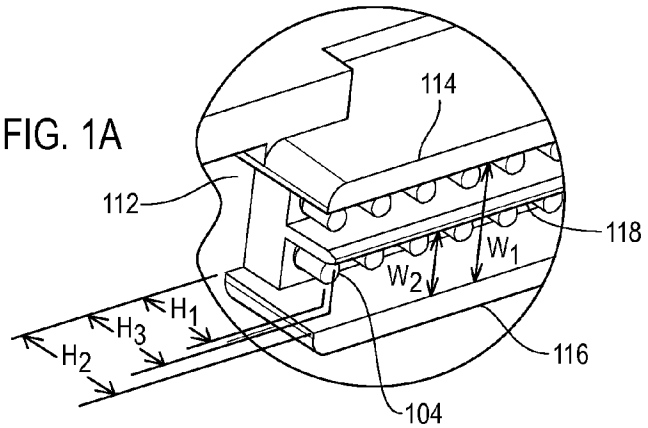
FIG. 1A is an enlarged view of a portion of the electrical cable assembly illustrated in FIG. 1, showing some features of the cable assembly in greater detail according to some embodiments.

The first body 102 may have a first surface 112. The plurality of electrical contacts 104 may be received in and supported by the first body 102 and protrude a distance H1 (FIG. 1A) from the first surface 112 configured to mate with target contacts. The first body 102 can be constructed from any suitable electrically insulating materials, including but are not limited to, various polymeric materials such as polyesters or other materials known in the art. The electrical contacts 104 can be made from any suitable electrically conducting materials such as metals, metal alloys, etc. The electrical contacts 104 may be in any suitable forms including spring-loaded pins. The electrical contacts 104 may have either flat or domed contact surfaces. The contacts 104 may be rigid. In some embodiments, the contacts may be retractable so that they can be extended from a retracted from within the support body 102 when making connection to a target assembly such as a female end of another cable or a machine.

The access limiting body or the second body 108 may be configured to prevent an object such as a human body portion from accessing or touching the electrical contacts 104 protruding from the first body 104. The second body 108 may be a separate body removably coupled to the first body 102 or may be integral with the first body 102. The second body 108 may be constructed from any suitable electrically insulating materials, including but are not limited to, various polymeric materials such as polyesters or other materials known in the art. The second body 108 may include a first side wall 114 and a second side wall 116. The first and second side walls 114, 116 may be configured such that the plurality of electrical contacts 104 protruding from the first body 102 can be sandwiched therebetween. The first and second side walls 114, 116 may each define a height H2 (FIG. 1A) from the first surface 112 that is greater than the distance H1 of the electrical contacts 104 protruding from the first surface 112. The first and second side walls 114, 116 may also define a width W1 (FIG. 1A) that is smaller than the dimension of an object such as a human body portion so that access of the object to the electrical contacts 104 protruding from the first body 102 can be prevented.

FIGS. 1 and 2 show a plurality of electrical contacts 104 arranged in two rows for illustration purpose. One of ordinary skill in the art will appreciate that a plurality of contacts may be in a single row, more than two rows, or other suitable array configurations. In an embodiment of one or more contacts in a single row, the width between the first and second side walls can be defined to prevent an object such as a human body portion from touching the electrical contacts interposed between the side walls. By way of example, the width between the first and second side walls may range from 2 to 3 mm, which may prevent a human finger from touching the electrical contacts interposed between the side walls. The width between the first and second side walls may be selected in conjunction with their height from the first surface. In general, the higher the first and second side walls with respect to the contacts the wider their gap can become and still prevent the body portion from touching the electrical contacts. One of ordinary skill in the art will appreciate that the width dimension between the side walls can be readily changed or selected based the ratio of the height of the side walls to the height of contacts to accommodate various applications, and the principles of this disclosure are not limited to the specific dimensions for preventing access of human fingers.

In an embodiment of a plurality of electrical contacts arranged in two or more rows, as illustrated in FIGS. 1 and 2, the access limiting body or the second body 108 may optionally include one or more dividing walls or dividers 118. The divider or dividers 118 may be configured to separate two adjacent rows of electrical contacts 104. As such, each row of electrical contacts 104 can be sandwiched between a side wall and a divider, or between two dividers in embodiments where a plurality of electrical contacts are arranged in more than two rows. The divider or dividers 118 may each define a height H3 (FIG. 1A) from the first surface 112 that is greater than the distance H1 of the electrical contacts 104 protruding from the first surface 112. A divider 118 and a side wall 114 or 116 or two adjacent dividers may define a width W2 configured to prevent an object such as a human body portion from touching the electrical contacts 104. Therefore, the use of the divider(s) 118 and side walls 114, 116 may prevent access of a human body portion from touching any electrical contacts, either adjacent contacts in a same row or contacts in neighboring rows. By way of example, the width W2 between a divider 118 and a side wall 114 or 116 or between two dividers may range from 2 to 3 mm, which may prevent a human finger from touching the electrical contacts 104. The width between a divider and a side wall or between two dividers may also be determined based on their height from the first surface. In general, the higher the side walls and dividers with respect to the contacts, the wider their gap can become and still prevent the body portion from touching the electrical contacts. One of ordinary skill in the art will appreciate that the width between a divider and a side wall or between dividers can be readily changed or selected based the ratio of the height of the side walls/dividers to the height of contacts to accommodate other applications, and the principles of this disclosure are not limited to the specific dimensions for preventing access of human fingers.

Figure 3A:
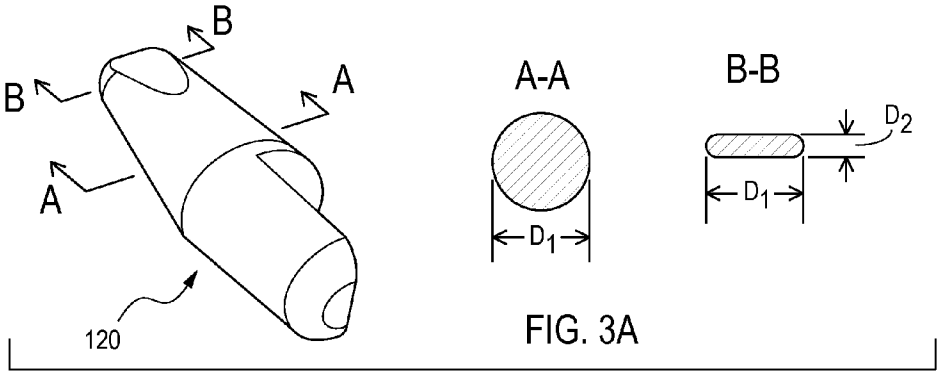
FIG. 3A illustrates an exemplary test finger according to some embodiments of this disclosure.
Figure 3:
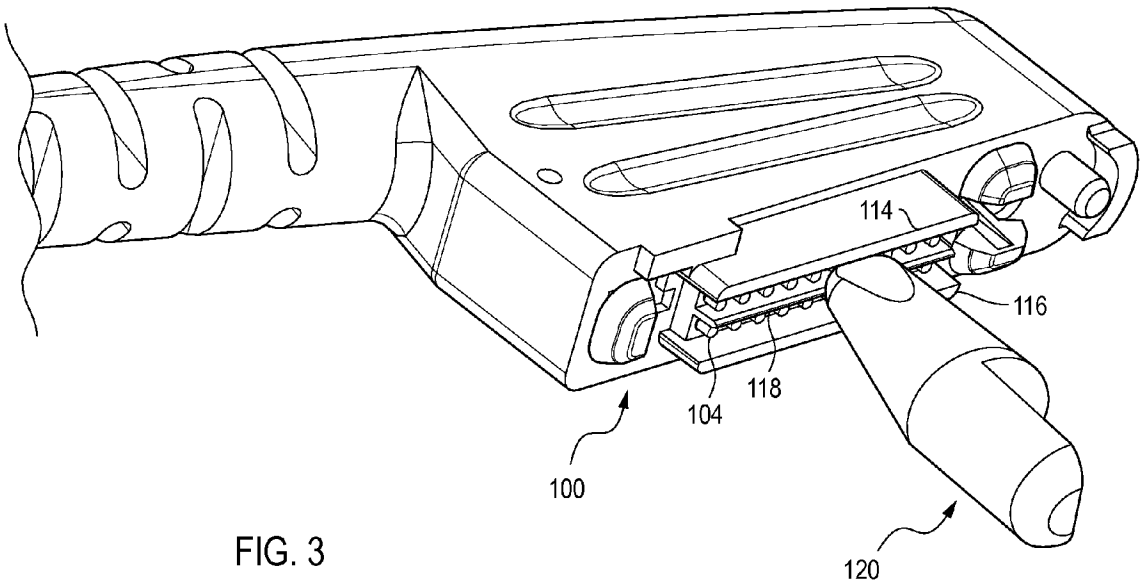
FIG. 3 is a perspective view of an exemplary electrical cable assembly and a test finger attempting to access the contacts in the cable assembly.
Figure 4:
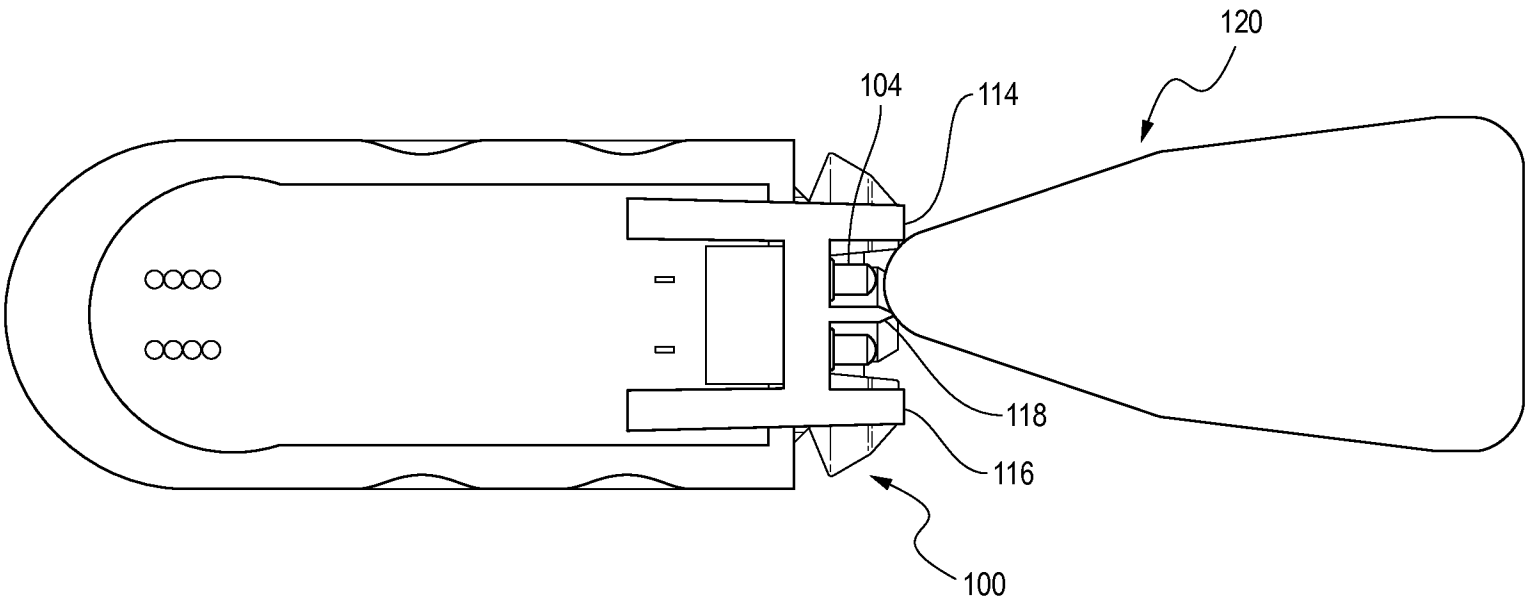
FIG. 4 is a cut-away side view of the cable assembly and the test finger illustrated in FIG. 3.

FIG. 3 is a perspective view showing an exemplary test finger 120 attempting to touch the electrical contacts 104 in a cable assembly 100. FIG. 4 is a cut-away side view of the cable assembly 100 shown in FIG. 3 and an exemplary test finger 120 attempting to touch the electrical contacts 104 in the cable assembly 100. As shown in FIGS. 3 and 4, the test finger 120 is not capable of touching the contacts 104 due to the separating divider 118 and/or the side walls 114, 116 configured to prevent the access by the test finger 120. The test finger 120 may have a configuration including a size and a shape simulating a human finger of an average user. For example, the test finger 120 may include a tapered end portion having a cross-section with a wider first dimension D1 and a narrower second dimension D2 (cross-section B-B of FIG. 3A). The method and apparatus described in this disclosure can prevent the test finger from shorting the contacts in the electrical cable assembly or other contact devices, no matter the test finger attempts to access the contacts with the wider first dimension or the narrower second dimension. The divider 118 may be rigid such that even if the test finger is pressed down hard against the divider 118 it would not touch both rows of the contacts.

Figure 5:
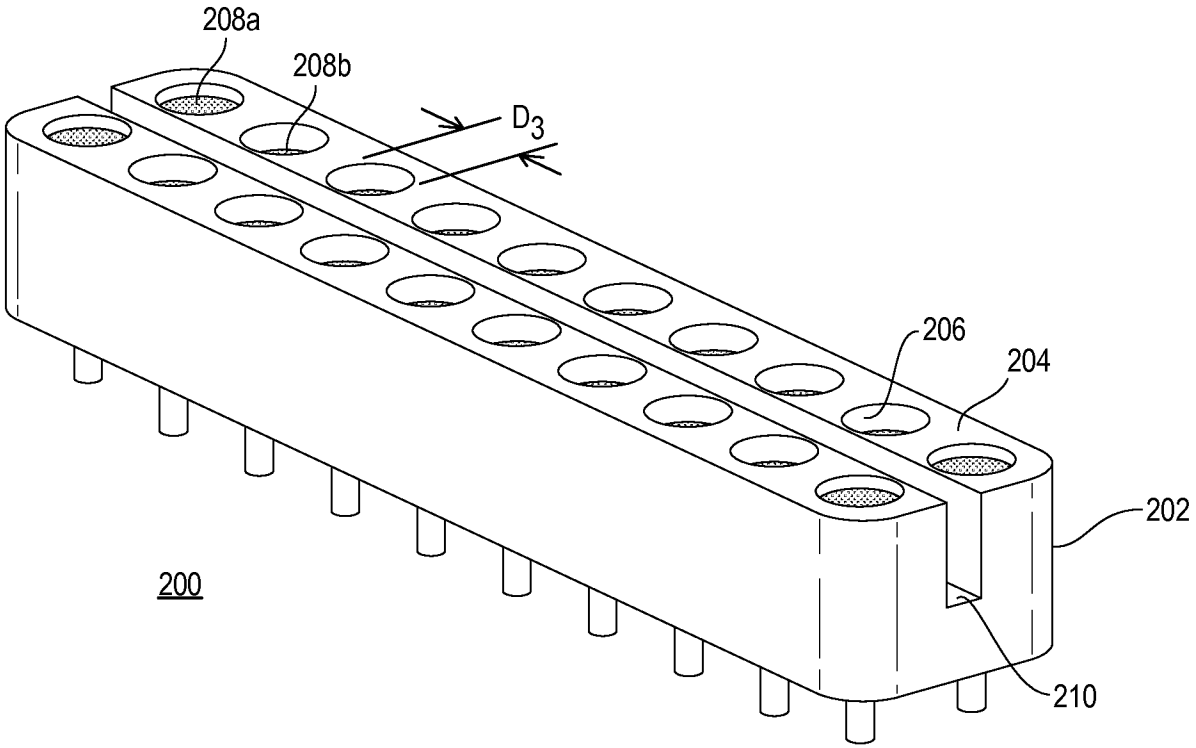
FIG. 5 is a perspective view of an exemplary electrical contact device according to some embodiments of this disclosure.
Figure 6:
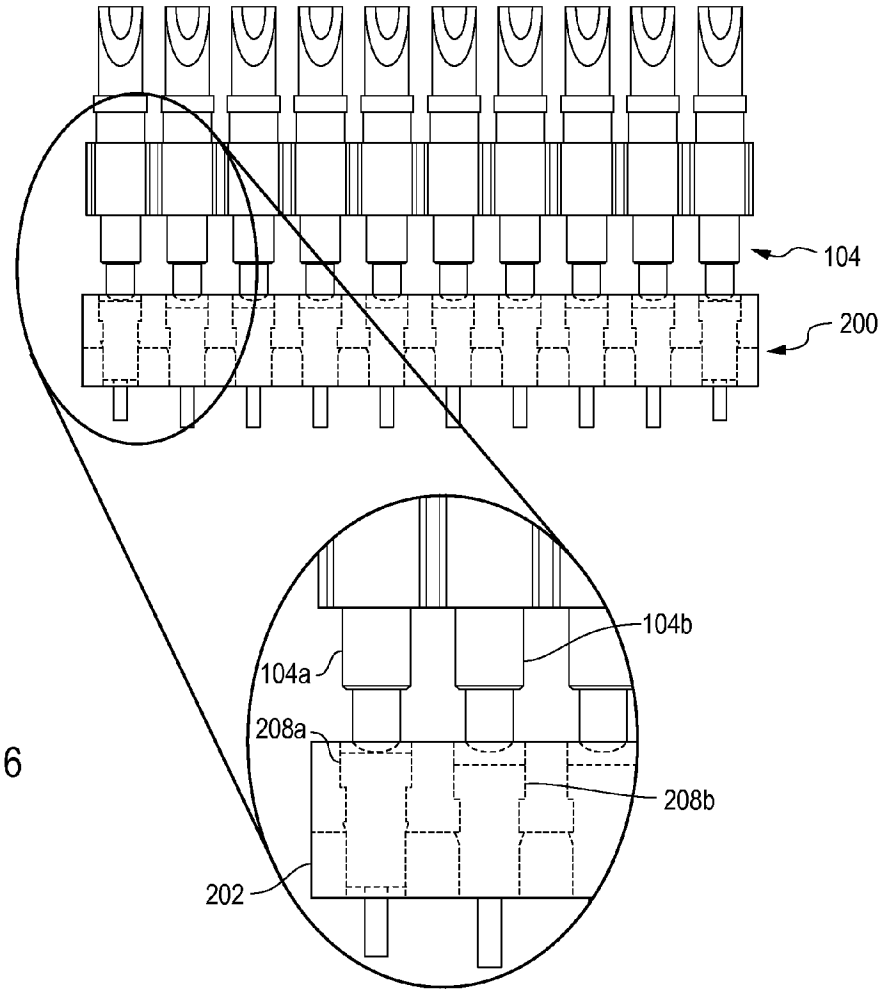
FIG. 6 illustrates an embodiment of first contact last disconnect application according to this disclosure.

FIG. 5 illustrates an exemplary electrical contact device 200 according to some other embodiments of this disclosure. The device 200 may include an electrically insulating body or a first body 202 having a first surface 204 and a plurality of recesses 206 through the first surface 204. A plurality of electrical contacts 208 (208*a*, 208*b*) may be received in the plurality of recesses 206. In some embodiments, the plurality of electrical contacts 208 received in the plurality of recesses 206 may be placed below the first surface 204. As such, a depth may be defined from the first surface 204 to the top of an electrical contact 208. The plurality of contacts 208 and the first surface 204 may define a same depth. Alternatively, some contacts (e.g. 208*a*) may have a depth different from that of the other contacts (e.g. 208*b*). In FIG. 5, contact 208*b* may be recessed deeper than contact 208*a*. One of the advantages of having different contact depths is that it allows for first contact last disconnect applications for hot-swapping through the use of raised contacts and recessed contacts of differing contact heights. This can be better illustrated in FIG. 6. When cable contacts 104 engage with target contact device 200, a ground contact 208*a* in device 200 may be touched first by a spring pin contact 104*a* before an active contact 208*b* is touched by a spring pin contact 104*b*, due to the varying depths of the contacts 208*a*, 208*b* in the device 200. Conversely, when disconnecting the contacts, the ground contact 208*a* may be disconnected last from spring pin contact 104*a* after contact 208*b* is disconnected from spring pin contact 104*b*. It should be noted that the relative locations of the raised ground contacts 208*a* on the side and recessed active contacts 208*b* in the middle are shown and described for illustration purpose. One of ordinary skill in the art will appreciate that the recessed contacts may be located on the side and the raised contacts in the middle, and the principle for hot-swapping application described above may equally apply.

Figure 7:
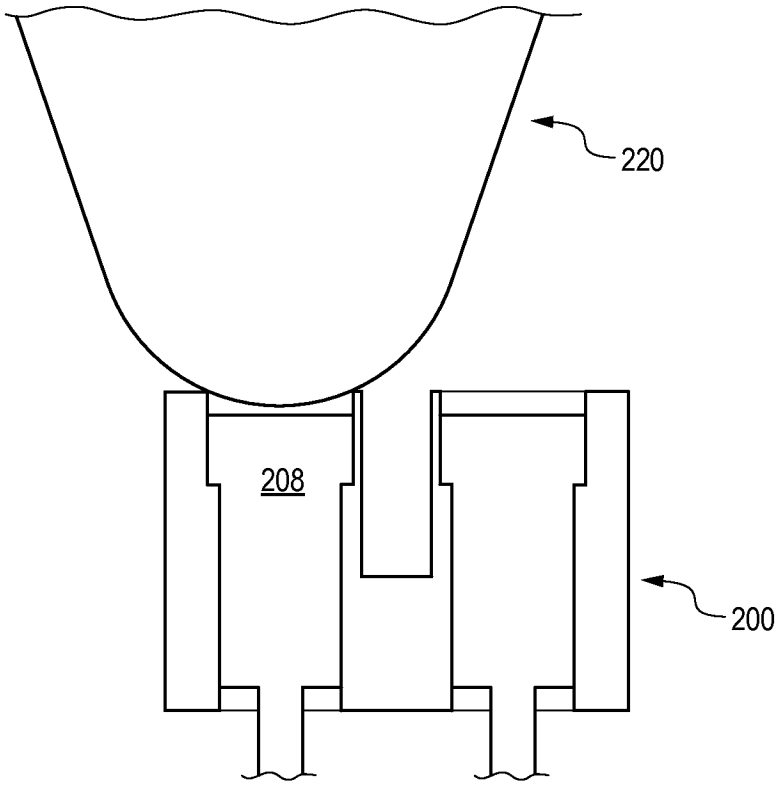
FIG. 7 is a cut-away side view of the electrical contact device illustrated in FIG. 5 and a test finger attempting to access the contacts in the device.

Returning to FIG. 5, the recesses 206 through the first surface 204 of the first body 202 may define an opening in a shape such as a circle, square, triangle, trapezoid, or any other regular or irregular shapes. The opening dimension D3 may be configured to be smaller than the dimension of an object such as a human body portion so that the object is not capable of touching the electrical contacts 208 in the recesses 206 below the first surface 204. In some embodiments, the opening dimension of the recesses 206 may be defined in conjunction with the depth of the recessed electrical contacts 208 to prevent an object from touching the electrical contacts 208. In general, the deeper the contacts the wider the recess opening can become and still prevent the body portion from touching the electrical contacts. By way of example, the recesses 206 in the first body 202 may define a circular opening having a diameter approximately 1.9 mm to prevent a human finger from touching the electrical contacts 208 placed in the recesses 206. One of ordinary skill in the art can readily modify the dimension or define the dimension in conjunction with the depth of the contacts to accommodate various applications, and the principles of this disclosure are not limited to the specific dimensions for preventing access of human fingers. FIG. 7 is a cut-away side view showing recessed electrical contacts 208 and a test finger 220 attempting to touch the electrical contacts 208. FIG. 7 shows that the test finger 220 is not capable of touching the electrical contact 208 due to the recesses and the opening dimension of the recesses.

The first body 202 of the electrical contact device 200 may be constructed from any suitable electrically insulating materials known in the art, including but are not limited to, various polymeric materials such as polyesters or other materials known in the art. The electrical contacts 208 may be made from any suitable electrically conducting materials such as metals, metal alloys, etc. known in the art.

FIG. 5 shows a plurality of contacts 208 placed in a plurality of recesses 206 arranged in two rows for illustration purpose. One of ordinary skill in the art will appreciate that a plurality of contacts may be arranged in a single row, more than two rows, or other suitable array configurations. The principles of this disclosure may also apply to a single electrical contact.

In an embodiment of a plurality of contacts in two or more rows as illustrated in FIG. 5, the first body 202 may further include one or more slots 210 between two adjacent rows of the recesses 206 and contacts 208. The slot 210 may be configured to receive a divider 118 in the access limiting body 108 as described above in connection with FIGS. 1-2.

Figure 8:
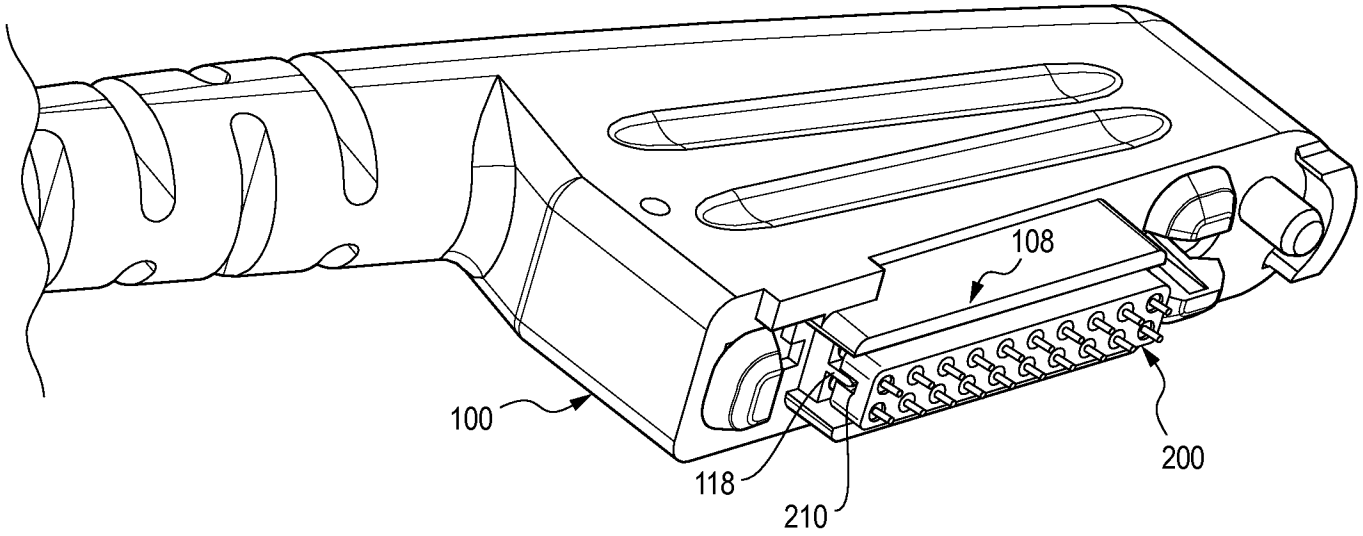
FIG. 8 illustrates an exemplary electrical cable assembly and a contact target assembly in mating position according to some embodiments of this disclosure.

FIG. 8 illustrates an electrical cable assembly 100 engaging with a contact target assembly 200 in mating position, where the divider 118 in the access limiting body 108 is received in the slot 210 in the contact target assembly 200.

Embodiments of electrical contact devices, connector assembly, and cable assembly are described. Those skilled in the art will appreciate that various modifications may be made within the spirit and scope of the disclosure. For example, the principles of this disclosure may apply to a single electrical contact or multiple contacts in a single row, multiple rows, or other array configurations. The principles of this disclosure may apply to either male or female contacts having flat or domed contact surfaces. All these or other variations and modifications are contemplated by the inventors and within the scope of the disclosure.

What is claimed is:

1. An electrical contact device, comprising:

a first body having a first surface;

a plurality of electrical contacts received in the first body and protruding a distance from the first surface, wherein the plurality of electrical contacts are arranged in a single row;

a second body comprising a first side wall and a second side wall, the first and second side walls being configured such that the plurality of electrical contacts protruding from the first surface are interposed between the first and second side walls;

wherein the first and second side walls each defines a height from the first surface greater than the distance of the plurality of electrical contacts protruding from the first surface, and the first and second side walls define a width smaller than a dimension of an object, thereby preventing the object from accessing to the plurality of electrical contacts protruding from the first surface.

2. The electrical contact device of claim 1 wherein the first and second side walls define a width smaller than a dimension of a human finger.

3. The electrical contact device of claim 1 wherein the first and second side walls define a width ranging from 2-3 mm.

4. The electrical contact device of claim 1 wherein the plurality of electrical contacts comprise male contacts in the form of pins.

5. An electrical contact device, comprising:

a first body having a first surface;

a plurality of electrical contacts received in the first body and protruding a distance from the first surface, wherein the plurality of electrical contacts are arranged in two or more rows and each of the two or more rows includes two or more electrical contacts;

a second body comprising a first side wall, a second side wall, and one or more dividers;

wherein the first and second side walls and the one or more dividers are configured such that at least one of the two or more rows of the plurality of electrical contacts protruding from the first surface are interposed between one of the one or more dividers and one of the first and second side walls;

wherein the first and second side walls and the one or more dividers each defines a height from the first surface greater than the distance of the plurality of the electrical contacts protruding from the first surface; and wherein the one of the one or more dividers and the one of the first and second side walls define a width smaller than a dimension of an object, thereby preventing the object from accessing to the plurality of electrical contacts protruding from the first surface.

6. The electrical contact device of claim 5 wherein the one of the one or more dividers and the one of the first and second side walls define a width ranging from 2-3 mm.

7. The electrical contact device of claim 5 wherein the plurality of electrical contacts comprise male contacts in the form of pins.

8. An electrical contact device, comprising:

a first body having a first surface and a plurality of recesses through the first surface;

a plurality of electrical contacts received in the plurality of recesses and below the first surface;

wherein the plurality of recesses define an opening dimension in the first surface that is smaller than a dimension of an object, thereby preventing the object from accessing to the plurality of electrical contacts below the first surface;

wherein the plurality of recesses are arranged in two or more rows and each of the two or more rows includes two or more recesses;

the plurality of electrical contacts are received in the plurality of recesses in two or more rows; and the first body further comprises one or more slots each between two adjacent rows of the plurality of recesses.

9. The electrical contact device of claim 6 wherein at least one of the plurality of electrical contacts received in one of the plurality of recesses and the first surface define a depth different from a depth or depths defined by remaining electrical contacts received in remaining recesses and the first surface.

10. The electrical contact device of claim 8 wherein the plurality of recesses define an opening in the shape of a circle, square, triangle, or trapezoid.

11. An electrical connector assembly, comprising:

a first component comprising a first body having a first surface and a plurality of first electrical contacts received in the first body and protruding a distance from the first surface, wherein the plurality of electrical contacts are arranged in a single row;

a second component comprising a second body having a second surface and a plurality of recesses through the second surface, and a plurality of second electrical contacts received in the plurality of recesses and configured to mate with the plurality of first electrical contacts of the first component; and a third component comprising a third body having a first side wall and a second side wall, the first and second side walls being configured such that the plurality of electrical contacts protruding from the first surface of the first body are interposed between the first and second side walls;

wherein the first and second side walls each defines a height from the first surface greater than the distance of the plurality of first electrical contacts protruding from the first surface, and the first and second side walls define a width smaller than a dimension of an object, thereby preventing the object from accessing to the plurality of electrical contacts protruding from the first surface.

12. The electrical connector assembly of claim 11 wherein the first and second side walls define a width ranging from 2-3 mm.

13. The electrical connector assembly of claim 11 wherein the plurality of second electrical contacts received in the plurality of recesses in the second body are below the second surface of the second body.

14. The electrical connector assembly of claim 13 wherein the plurality of recesses define an opening dimension of approximately 1.9 mm.

15. An electrical connector assembly, comprising:

a first component comprising a first body having a first surface and a plurality of first electrical contacts received in the first body and protruding a distance from the first surface, wherein the plurality of electrical contacts are arranged in two or more rows and each of the two or more rows includes two or more electrical contacts;

a second component comprising a second body having a second surface and a plurality of recesses through the second surface arranged in two or more rows, and a plurality of second electrical contacts received in the plurality of recesses in two or more rows configured to mate with the plurality of first electrical contacts in two or more rows; and a third component comprising a third body having a first side wall, a second side wall, and one or more dividers, the first and second side walls and the one or more dividers are configured such that at least one of the two or more rows of the first electrical contacts protruding from the first surface are interposed between one of the one or more dividers and one of the first and second side walls;

wherein the first and second side walls and the one or more dividers each defines a height from the first surface greater than the distance of the plurality of first electrical contacts protruding from the first surface;

wherein the one of the one or more dividers and the one of the first and second side walls define a width smaller than a dimension of an object, thereby preventing the object from accessing to the plurality of first electrical contacts protruding from the first surface; and wherein the second body of the second component has one or more slots configured to receive the one or more dividers of the third body.

16. An electrical cable assembly, comprising:

a first body having a first surface;

a plurality of electrical contacts received in the first body and protruding a distance from the first surface, wherein the plurality of electrical contacts are arranged in a single row;

a plurality of cables electrically coupled to the plurality of electrical contacts;

a second body comprising a first side wall and a second side wall, the first and second side walls being configured such that the plurality of electrical contacts protruding from the first surface are interposed between the first and second walls;

wherein the first and second side walls each defines a height from the first surface greater than the distance of the plurality of electrical contacts protruding from the first surface, and the first and second side walls define a width smaller than a dimension of an object, thereby preventing the object from accessing to the plurality of electrical contacts protruding from the first surface.

17. The electrical cable assembly of claim 16 wherein the first and second side walls define a width ranging from 2-3 mm.

18. The electrical cable assembly of claim 16 wherein the plurality of electrical contacts comprise male contacts in the form of pins.

19. An electrical cable assembly, comprising:

a first body having a first surface;

a plurality of electrical contacts received in the first body and protruding a distance from the first surface, wherein the plurality of electrical contacts are arranged in two or more rows and each of the two or more rows includes two or more electrical contacts;

a plurality of cables electrically coupled to the plurality of electrical contacts;

a second body comprising a first side wall, a second side wall, and one or more dividers;

wherein the first and second side walls and the one or more dividers are configured such that at least one of the two or more rows of the plurality of electrical contacts protruding from the first surface are interposed between one of the one or more dividers and one of the first and second side walls;

wherein the first and second side walls and the one or more dividers each defines a height from the first surface greater than the distance of the plurality of electrical contacts protruding from the first surface; and wherein the one of the one or more dividers and the one of the first and second side walls define a width smaller than a dimension of an object, thereby preventing the object from accessing to the plurality of electrical contacts protruding from the first surface.

20. The electrical cable assembly of claim 19 wherein the one of the one or more dividers and the one of the first and second side walls define a width ranging from 2-3 mm.

21. The electrical cable assembly of claim 19 wherein the plurality of electrical contacts comprise male contacts in the form of pins.

* * * * *